US007374447B2

(12) United States Patent
Matsumoto

(10) Patent No.: US 7,374,447 B2
(45) Date of Patent: May 20, 2008

(54) SECURE CONNECTION DEVICE

(75) Inventor: Yoshio Matsumoto, Tokyo (JP)

(73) Assignee: Allied Telesis Holding K.K., Tokyo (JP)

( * ) Notice: Subject to any disclaimer, the term of this patent is extended or adjusted under 35 U.S.C. 154(b) by 0 days.

(21) Appl. No.: 11/653,426

(22) Filed: Jan. 16, 2007

(65) Prior Publication Data

US 2007/0259560 A1 Nov. 8, 2007

Related U.S. Application Data

(60) Provisional application No. 60/758,571, filed on Jan. 13, 2006.

(51) Int. Cl.
*H01R 13/625* (2006.01)

(52) U.S. Cl. ..... 439/344

(58) Field of Classification Search ..... 439/344, 439/372, 352

See application file for complete search history.

(56) References Cited

U.S. PATENT DOCUMENTS 3,997,234 A * 12/1976 Worman ..... 439/456
5,398,295 A * 3/1995 Chang et al. ..... 385/58
5,579,425 A * 11/1996 Lampert et al. ..... 385/59
5,795,174 A * 8/1998 Saito et al. ..... 439/310
5,879,199 A * 3/1999 Belopolsky ..... 439/701
6,109,978 A * 8/2000 Stellman et al. ..... 439/701
6,123,564 A * 9/2000 Belmore, III ..... 439/344
6,158,111 A * 12/2000 Doye et al. ..... 29/739
6,190,192 B1 * 2/2001 White et al. ..... 439/292
6,250,817 B1 * 6/2001 Lampert et al. ..... 385/56
6,343,950 B1 * 2/2002 Eginton et al. ..... 439/540.1
6,409,392 B1 * 6/2002 Lampert et al. ..... 385/56
6,547,585 B2 * 4/2003 Bradley et al. ..... 439/353
6,595,798 B1 * 7/2003 Pook ..... 439/540.1
6,783,391 B2 * 8/2004 Schlueter et al. ..... 439/540.1
6,796,844 B1 * 9/2004 Edwards, III ..... 439/638
6,857,900 B2 * 2/2005 Kleeberger et al. ..... 439/540.1
7,140,911 B1 * 11/2006 Rector et al. ..... 439/540.1

* cited by examiner

*Primary Examiner*—Ross Gushi
(74) *Attorney, Agent, or Firm*—Arent Fox LLP

(57) ABSTRACT

A cable connector holder including a base configured to hold a plurality of cable connectors and a press part attached to the base and extending above the plurality of cable connectors, wherein the lever is configured to uniformly press down on each of the plurality of cable connectors to render the cable connectors collectively removable from a network device. The cable connector may further include a press prevention mechanism that prevents the press part from engaging the levers of the cable connectors, thereby preventing the removal of the plurality of connectors in the connector holder from a network device.

20 Claims, 12 Drawing Sheets

SECURE CONNECTION DEVICE

This application is based upon and claims the benefit of priority from prior U.S. Provisional Application No. 60/758,571 filed on Jan. 13, 2006, the entire contents of which is incorporated herein by reference.

BRIEF DESCRIPTION OF INVENTION

1. Field of the Invention

The present invention is generally directed to a cable connector holder including a press piece that collectively presses a first lever on each of a plurality of connectors placed in the holder such that the plurality of connectors may be integrally attached and detached from a network apparatus. Among other things, this reduces the amount of labor required for attaching and detaching cable connectors in comparison with that required for attaching and detaching connectors to and from a network apparatus by pressing the individual lock mechanisms on the connectors one by one.

2. Background of the Invention

The cable connector holder relates to the maintenance of connectors such as a modular jack of an Unshielded Twisted Pair (UTP) cable. Connecting a cable such as a UTP cable involves detaching and attaching one cable at a time to a network device. JP 2002-344156 provides a holder tool for collectively holding a plurality of cables. Even though the cables are held collectively, there is no change in that each cable must be attached to and detached from a network device one cable at a time. This tedious work requires great time and effort, especially at the time of installation or during maintenance of a large network device.

SUMMARY OF INVENTION

There is a need in the art, therefore, for a cable connector holder that reduces the time and effort of attachment and detachment of a plurality of cables. The present invention solves the above-identified needs, as well as others by providing both a cable connector holder that enables a plurality of connectors to be attached and detached in a collective manner. An embodiment of present invention provides a cable connector holder including a base configured to hold a plurality of cable connectors and a press part configured to uniformly press down on a plurality of levers corresponding to each of the plurality of cable connectors such that the cable connectors become removable from a network device.

The cable connector may further include a press prevention mechanism that prevents the press piece from engaging the levers of the cable connectors, thereby preventing the removal of the plurality of connectors in the connector holder from a network device.

Another embodiment comprises a cable connector holder including a base configured to hold a plurality of cable connectors; and a lever rotatably attached to the base and extending above the plurality of cable connectors, wherein the lever is configured to uniformly press down on each of the plurality of cable connectors to render the cable connectors removable from a network device.

This embodiment may also be provided with a press prevention mechanism.

Among other things, this reduces the amount of labor required for attaching and detaching cable connectors in comparison with that required for attaching and detaching connectors to and from a network apparatus by pressing the individual lock mechanisms on the connectors one by one.

Other features and advantages will be apparent to persons of ordinary skill in the art from the following detailed description of the invention and the accompanying drawings.

BRIEF DESCRIPTION OF THE FIGURES

For a more complete understanding of the present invention, the needs satisfied thereby, and the objects, features, and advantages thereof, reference is now made to the following description taken in connection with the accompanying drawings. Identical parts in the several views of the drawings use the same reference numbers.

DETAILED DESCRIPTION

Figure 1:
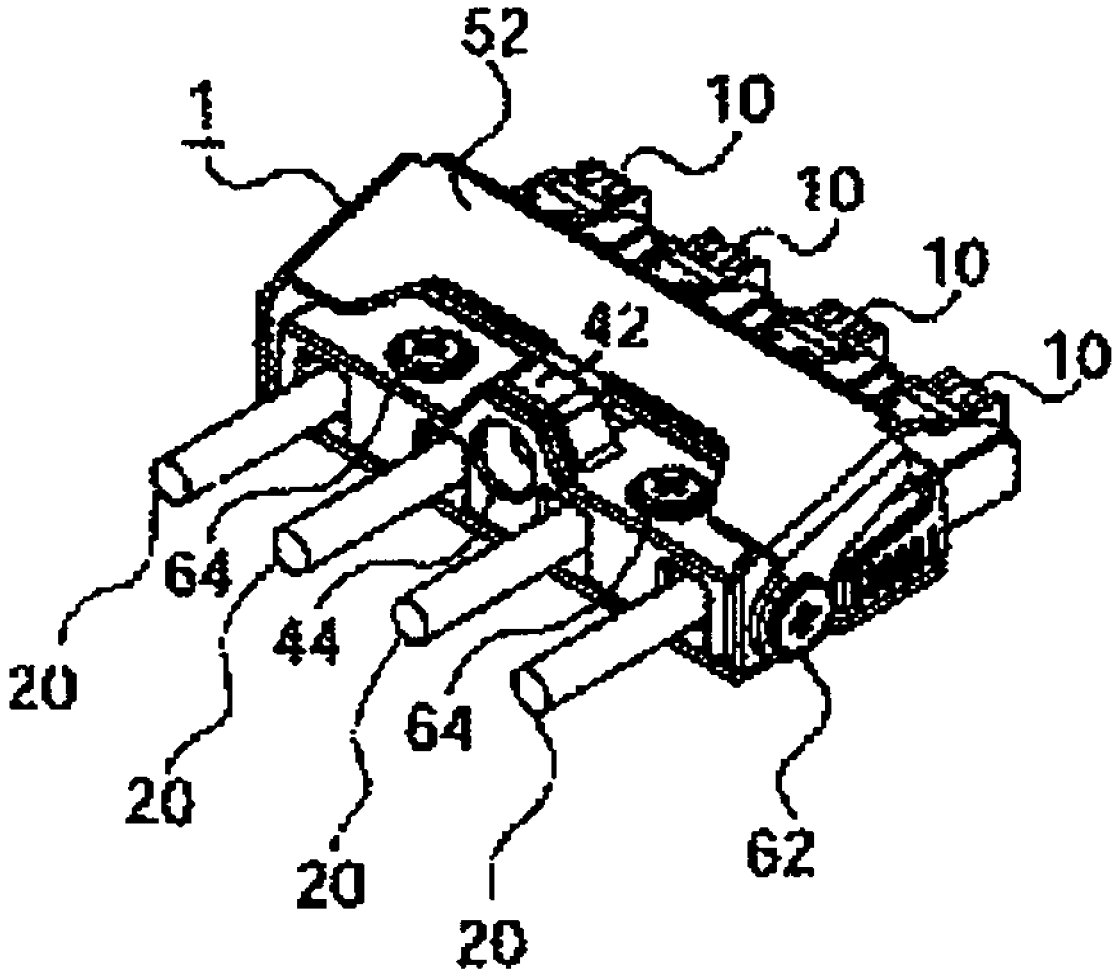
FIG. 1 depicts a cable connector holder according to an embodiment of the present invention.

Referring now to FIG. 1, the general configuration of a cable connector holder made in accordance with an embodiment of the present invention is shown. In FIG. 1, a connector 10 is attached at the end of a cable 20. The connector 10 is depicted as a modular jack, such as an 8P8C modular connector. The cable 20 may be, for example, an Unshielded Twisted Pair (UTP) cable. The connector holder 1 is shown in this embodiment as holding four connectors 10; however, the number of cables may be any number of two or more. The holder 1 includes a lever 50 arranged to cover each of the plurality of connectors. When the lever 50 is pushed, as will be described later, the plurality of connectors are rendered collectively attachable to or removable from a network device. The connector holder 1 includes a second press prevention section 42 formed at the side of the holder from which the cable 20 projects out of the connector holder. An opening 44 is formed in the second press prevention section 42 generally in the direction that the cable 20 extends.

Figure 2:
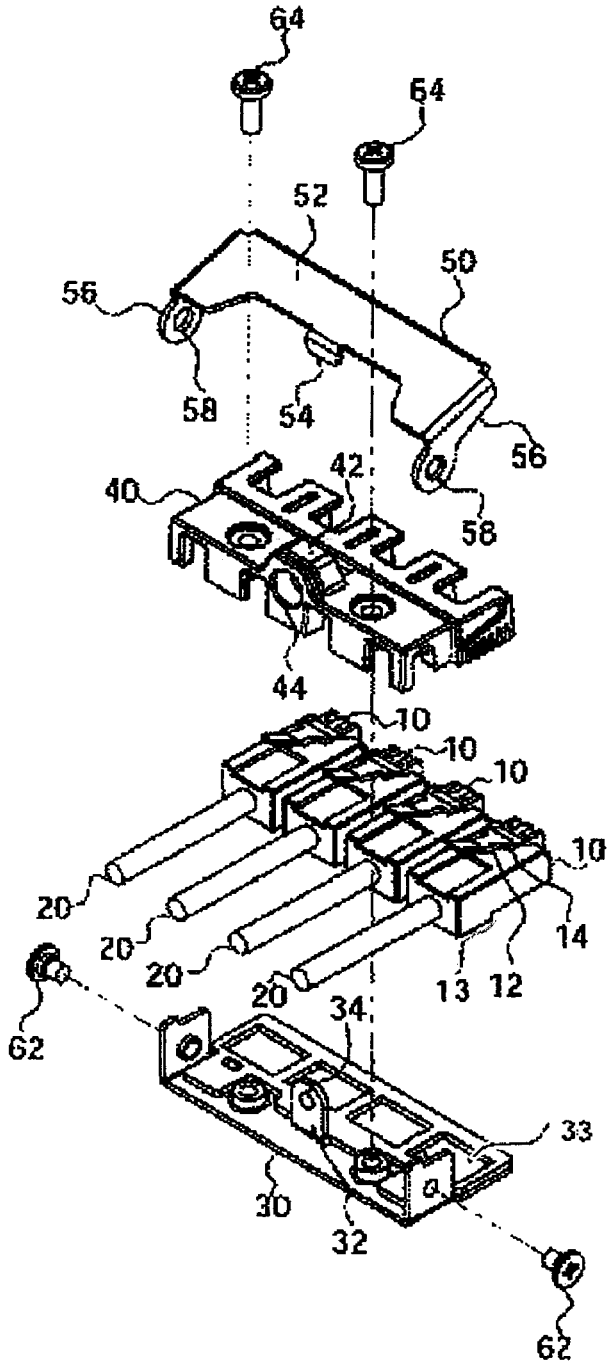
FIG. 2 is an exploded view of the cable connector holder depicted in FIG. 1.

FIG. 2 shows a dissembled view of the connector holder 1 depicted in FIG. 1. The connector holder is equipped with a base 30, a holder 40, and the press part 52, which are held together via attaching pieces 62 and 64. FIG. 2 depicts attaching pieces 62 and 64 as screws; however, other mechanisms and methods for holding the parts of the connector holder together may be used. In the exemplary embodiment of FIG. 2 the base 30 has a first press prevention member 32 with a threaded opening 34. The first press prevention section 32 is located closer to the connectors 10 than the second press prevention section 42. The threaded opening 34 in the first press prevention section 32 shares a common central axis with an opening 44 in the second press prevention section 42.

During assembly the four connectors depicted in FIG. 2 are placed in order on the base 30 so that a projection 13 on the lower surface of each of the connectors 10 is inserted in the corresponding one of the openings 33 formed in the base 30. Each connector 10 includes, for example, a first lever 12 and a lever shoulder 14. The tip of the first lever is narrower than the part of the lever closer to the main portion of the connector. The section of the lever just before the width becomes narrow is called the lever shoulder 14. In use, when the first lever 12 extends upwards, the lever shoulder 14 engages with a stop in a female connector of a network device in which the connector is inserted, and the connector is not removable. When the first lever 12 is pushed down toward the top face of the connector 10, the lever shoulder disengages from the stop, and the connector becomes removable from the network device. When the first lever 12 is not being pushed, it extends upwards as depicted in FIG. 2.

A holder 40 encases the top face of the connector 10 and is attached to the base 30. The second press prevention section 42 is formed in the holder 40. The holder is fixed to the base 30 by the attaching piece 64 during assembly. At this point, the plurality of connectors 10 is fixed within the holder 40 and the base 30.

The lever 50 on the connector holder 1 attaches to the base 30 over the holder 40. The lever 50 on the connector holder has a press part 52, a lobe 54, and two side attachment walls 56, with installation holes 58. The lobe 54 is formed on the side of the press part 52 closest to the rear of the connectors 10. The lever 50 is attached to the base using the attaching pieces 62 during assembly.

The press part 52 covers the narrow tip of the first lever 12 of each of the plurality of connectors 10. The side attachment walls 52 are parallel to the direction that the cable 20 generally extends. When pressed down toward the top face of the connectors 10, the press part 52 rotates around the central axis of the openings 58, thereby coming into contact with the plurality of first levers 12 corresponding to the plurality of connectors 10 so that the first levers are pushed downwards. When the first levers 12 on the connectors are pushed downwards, the lever shoulders 14 can disengage from the stops in the corresponding female connector of the network device so that the connectors become collectively removable.

Figure 3:
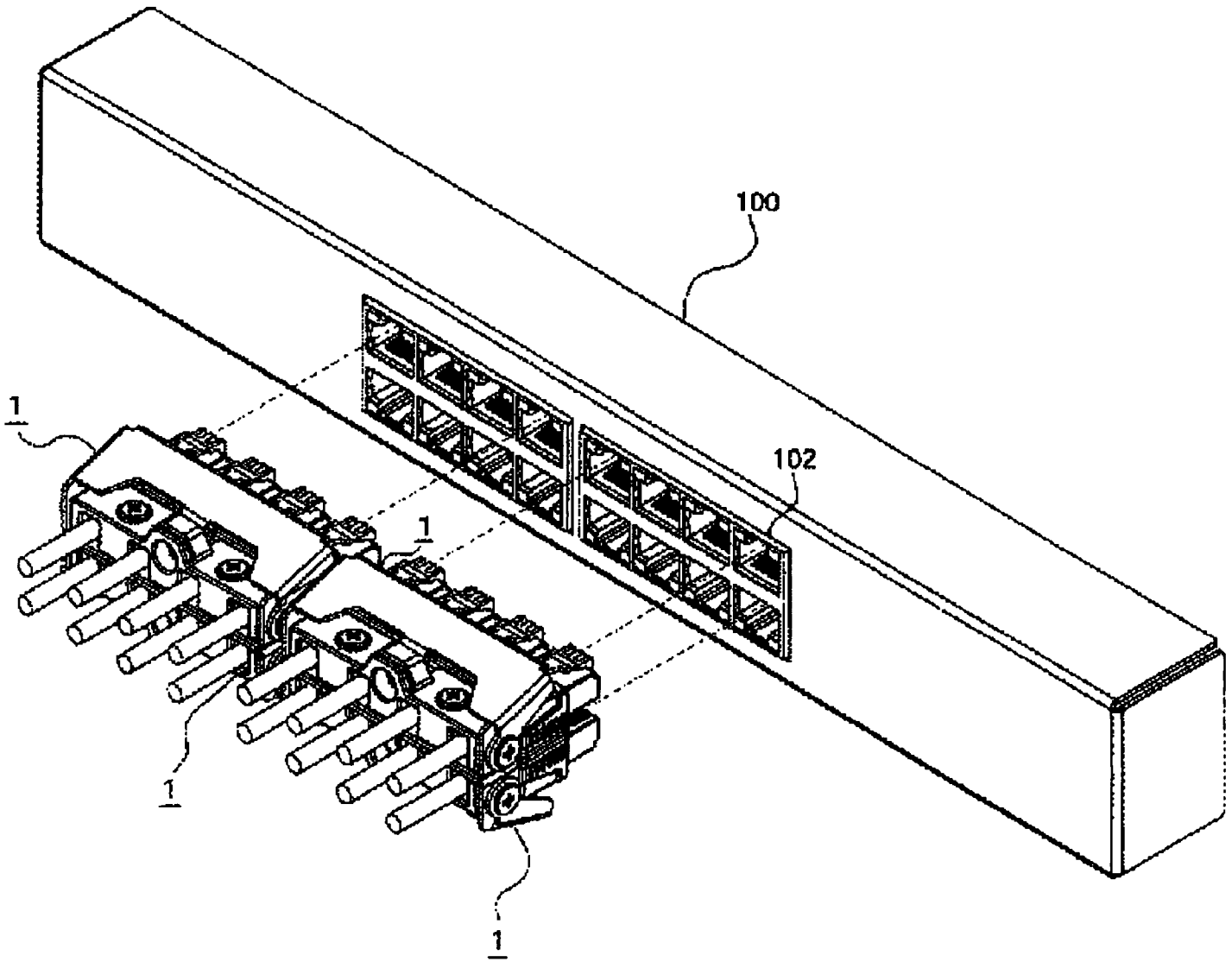
FIG. 3 is a perspective view of a cable connector holder, according to an embodiment of the present invention, used in connection with a network device.

FIG. 3 shows a perspective view of an exemplary embodiment having a plurality of connectors 10 having cables 20 held by a connector holders 1 at the time of connecting to a network device 100. As shown in FIGS. 3, 7, 11, and 12, individual cable connector holders 1 can be attached to each other. The network device may be a hub and router and includes a plurality of female connectors 102. In the embodiment depicted in FIG. 3, the network device 100 includes sixteen (16) female connectors 102. In this embodiment, four connector holders 1, each holding four connectors 10 similar to the connector holder in FIG. 1, are shown corresponding to the sixteen female connectors 102. The four connectors held by each connector holder 1 are collectively inserted into a group of female connectors 102 and engages with them.

Figure 4:
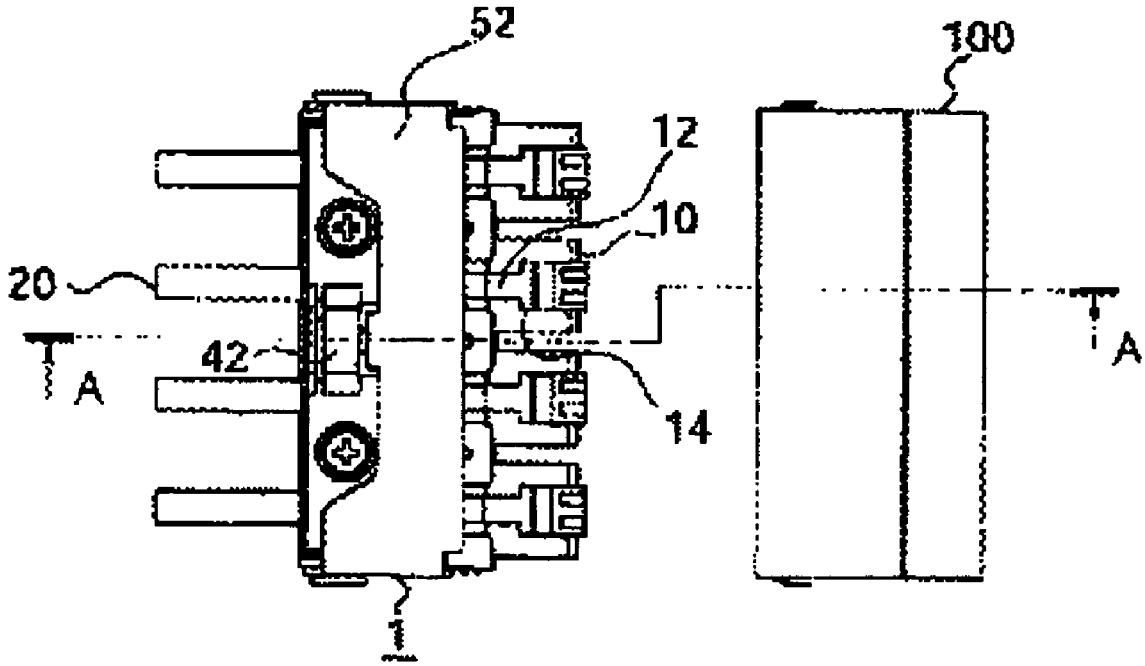
FIG. 4 is a top perspective view of a cable connector holder, according to an embodiment of the present invention, used in connection with a network device.

FIG. 4 shows a top view of a connector holder 1 at the time of connecting to a network device 100.

Figure 5:
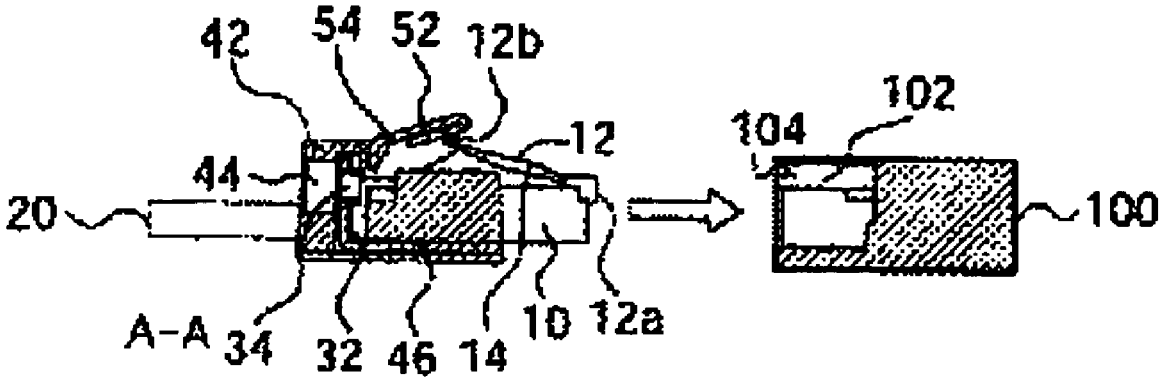
FIG. 5 is a side sectional view along A-A in FIG. 4.

FIG. 5 is the sectional view of FIG. 4 taken along line A-A. The first lever 12 is connected to the connector 10 at base 12*a* of the first lever 12. The tip 12*b* of the first lever 12 is pressed down by the press part 52 when the lever 50 of the connector holder 1 is pressed. Adjacent connectors are separated by a dividing wall 46. FIG. 5 also shows the stop 104 of the female connector 102 which catches the first lever shoulder 14 when the connector 10 is inserted and the first lever is not pressed down. The connector 10 is inserted into the female connector 102 of the network device 100 in the direction of the arrow.

Figure 6:
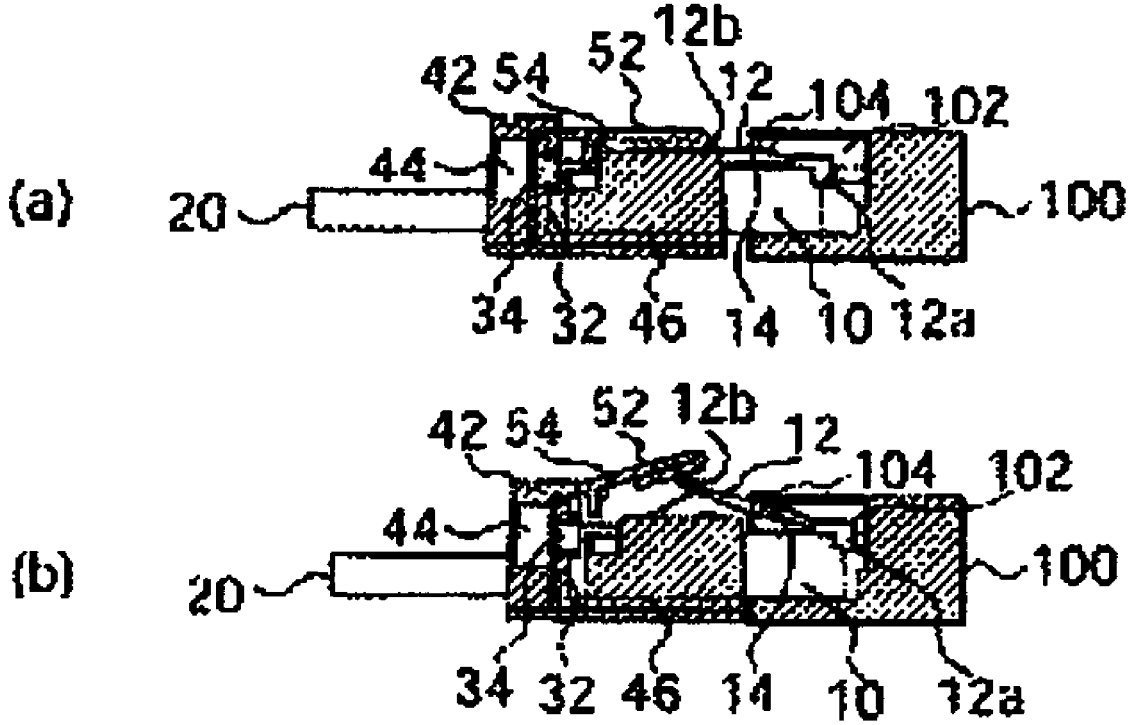
FIG. 6 is a side sectional view along A-A in FIG. 4 during and after attachment.

FIG. 6(*a*) is a sectional view of the connector holder similar to FIG. 5 at the time when the press part 52 and the lever 50 are down and the connector 10 is inserted into a female connector 102 of the network device 100. After the connector 10 engages with the female connector 102 the press part 52 is released and lever 50 and the first lever 12 are allowed to rise until the lever shoulder 14 is held by the stop 104 of the female connector as shown in FIG. 6(*b*).

FIG. 5 shows the tip 12*b* of the first lever 12 engaged to be pressed downward by the press part 52. As the press part 52 covers the first levers 12 of each connector 10 in the connector holder 1, all of the first levers 12 of the connectors 10 are pressed down collectively and simultaneously toward the top face of their connectors. In this state, the connectors inserted into the female connectors 102 will be in the state shown in FIG. 6*a*. While the first lever is pressed down by the second lever, as shown in FIG. 6*a*, the lever shoulder 14 is located beneath the stop 104 in the female connector and the connector is not engaged or held by the stop.

Once the connectors 10 in the connector holder 1 are inserted into the female connectors 102 of the network device 100, the press part 52 is released and the first lever 12 will rise as shown in FIG. 6*b*. The lever shoulders 14 rise within the female connectors to the height of the stops 104. In this position, the lever shoulders are held by the stops 104 and the connectors 10 remain inserted in the female connectors 102.

Although FIG. 5 shows the press part 52 being pushed as the connector holder 1 inserts the connectors into the network device, this is not necessary. When a connector is pressed into a female connector without pressing the press part 52, the lever 12 is automatically pushed downward by the stop 104, the lever shoulder 14 engages the stop 104 and comes to the state shown in FIG. 6*b*.

After the connectors have been inserted into the network device and are held in the female connectors by stops 104, the connectors 10 can be released by pressing down on the press part 52 so that each of the lever shoulders 14 on the connectors are pressed beneath the stops 104 and disengage from the network device, as shown in FIG. 6(*a*). Then, the connectors can be collectively removed by pulling the connector holder away from the network device.

At the end of network installation or network maintenance for a particular connector, it is common to continue working on or with the network device. Therefore, it is beneficial to ensure that a connector 10 does not easily fall out of the network device after insertion. In addition, it is beneficial to prevent having the connection between a connector and the network device be changed by persons other than a network administrator. The connectors should be held so that they are not easily disconnected from the network device by persons other than a network administrator. An embodiment of the connector holder according to the present invention provides for connectors to be held securely in the network device through the use of a lock or press prevention piece 70.

Figure 7:
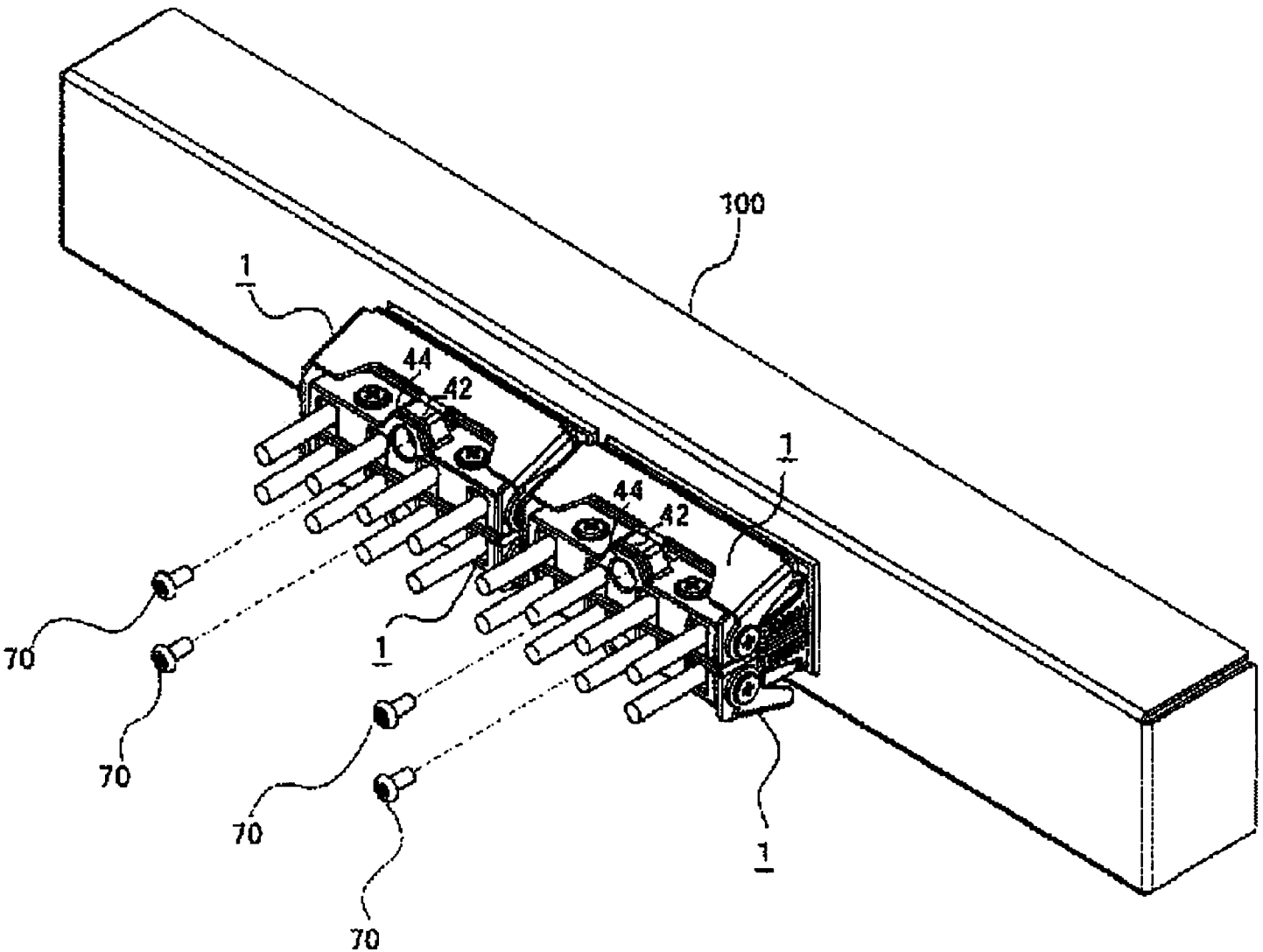
FIG. 7 is a perspective view of a cable connector holder, according to an embodiment of the present invention, including a lock.

FIG. 7 shows a lock 70 being inserted into connector holders 1 after the connectors 10 have been inserted into the network device 100. The lock 70 is a piece inserted into the opening 44 in the second press prevention section 42 and extending through the opening in the first press prevention section of the connector holder 1.

Although a standard slotted or Philips screw may be used for a lock 70, it may be beneficial in certain circumstances to use a security type screw such as a TORX® or a Security TORX®. The drivers for use with such security types of screws are not as common as a slotted or Philips type driver. Thus, if a network administrator chooses one of the less common screw types, it will be more difficult for a person other than the network administrator to remove the lock 70 from the connector holder 1 and to change the relationship between the connectors and the network device established by the network administrator.

Figure 8:
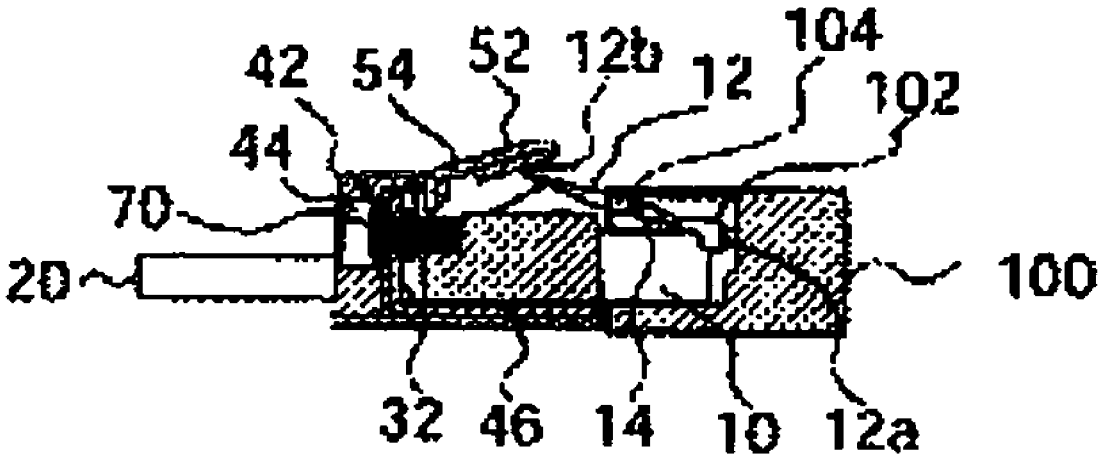
FIG. 8 is a side sectional view along A-A when a lock is in place.

FIG. 8 is a sectional view of a connector holder 1 taken along line A-A of FIG. 4 with the connectors inserted into a network device 100 and with a lock 70 inserted into the connector holder 1. The lock 70 inserts through the opening 44 in the second press prevention section 42, and a part of the lock 70 inserts through the opening 34 in the first press prevention section 32 of the connector holder. For example, in an embodiment using a screw as the lock 70, the head of the screw remains in the opening 44, while the threaded portion of the screw extends through the threaded opening 34. The lobe 54 of the lever 50 on the connector holder is situated above the shank portion of the lock 70, for example, the threaded portion of the screw.

When the lock 70 is inserted into the connector holder 1, as shown in FIG. 8, the connectors in the connector holder cannot be removed from the female connectors of the network device. With the lock 70 in place, the press part 52 cannot be pressed down because the lobe 54 collides with the shank portion of the lock 70. Thus, the press part 52 cannot press down on the first lever 12 of the connectors 10 within the connector holder 1, and the connectors remain held in the network device 100 by the stops 104.

Figure 9:
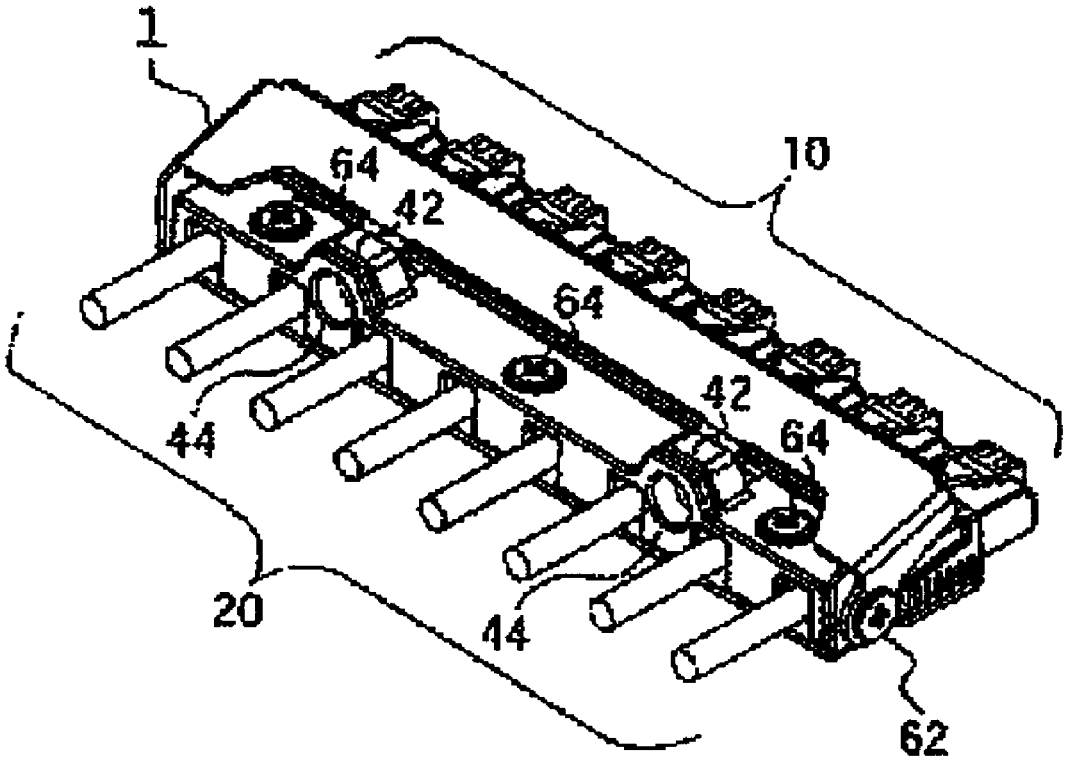
FIG. 9 is a perspective view of a cable connector holder according to an embodiment of the present invention.

FIGS. 1-4 and 7 each show a connector holder 1 designed to hold four connectors. However, the connector holder can hold any plurality of two or more connectors. The connector holder 1 may be manufactured to hold six, eight, ten connectors, etc or even an odd number of connectors, if the particular network device so requires. A modification wherein the connector holder holds eight connectors is shown in FIG. 9. Corresponding parts have been assigned corresponding reference numbers, and an explanation of these corresponding parts can be found in connection with FIGS. 1-7.

In FIG. 9, the number of attaching pieces 64 is increased from two pieces to three pieces. However, their function and purpose are identical to the pieces 64 in the prior example. The second press prevention section 42 may also be increased from one section to two sections. FIG. 9 shows one of the second press prevention sections being formed between the second and third cables from the left hand side, and the other second press prevention section being formed between the second and third cables from the right hand side.

Figure 10:
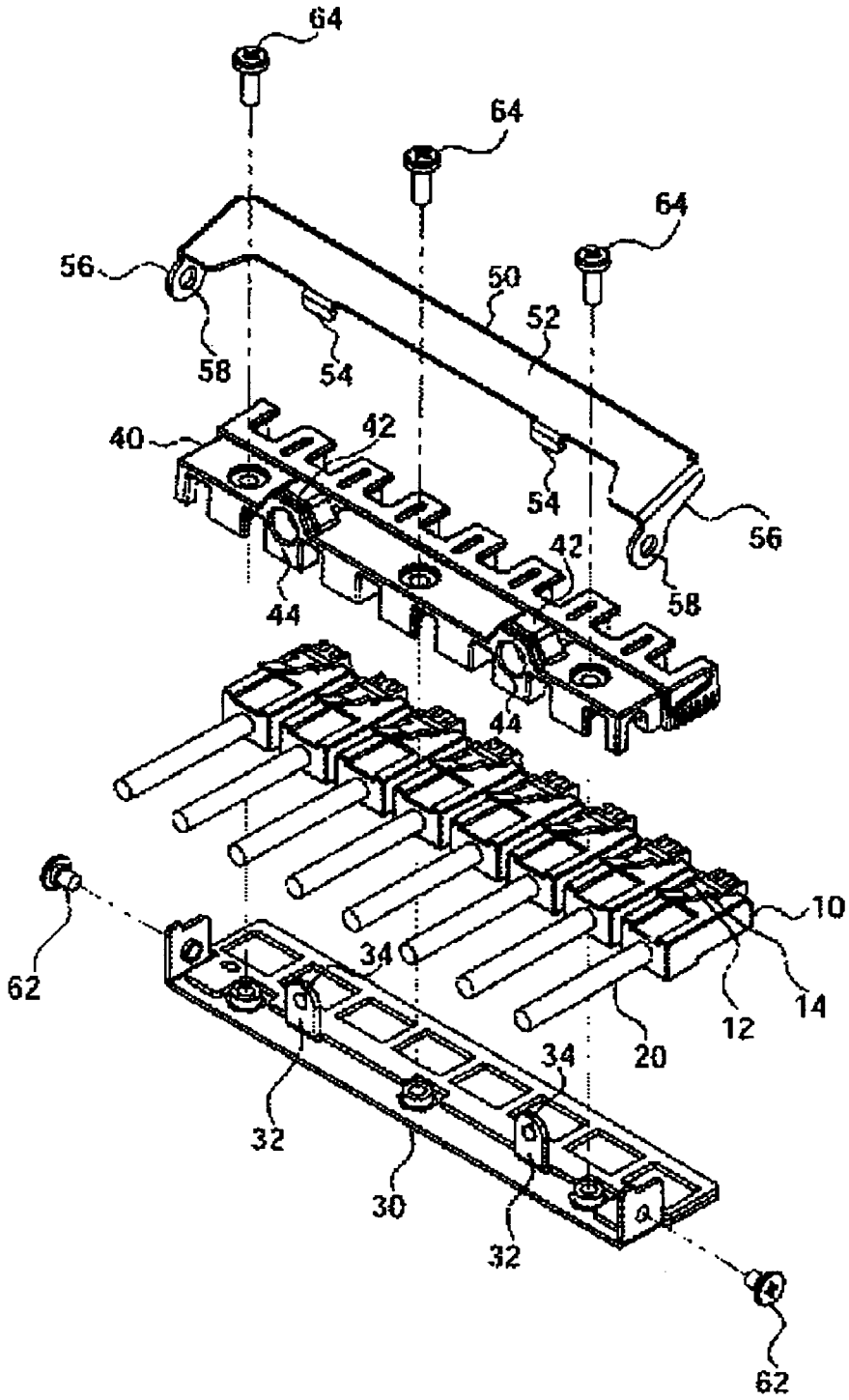
FIG. 10 is a dissembled view of the cable connector holder depicted in FIG. 9.

FIG. 10 shows a dissembled view of the connector holder depicted in FIG. 9. FIG. 10 shows the base 30 having two first press prevention sections 32, each having a threaded opening 34. These two sections 32 are formed in a location corresponding to the second press prevention section 42 so that the threaded opening 34 in the first press prevention section 32 has a central axis corresponding to the central axis of the opening 44 in the second press prevention section 42. FIG. 10 also shows the lever 50 on the connector holder having two lobes 54 in a locations corresponding to the locations of the first and second press prevention sections.

Figure 11:
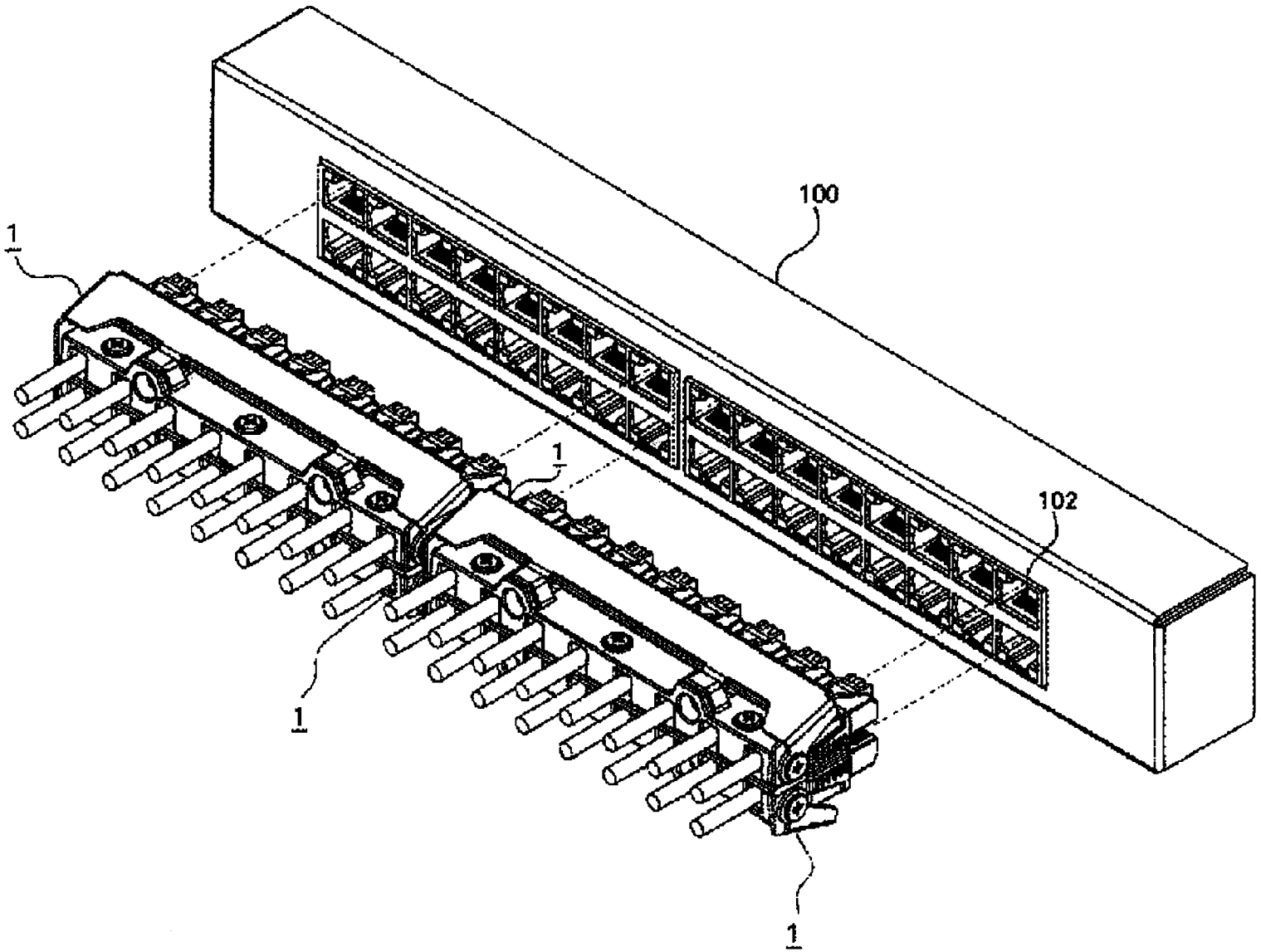
FIG. 11 is a perspective view of the cable connector holder depicted in FIG. 9 used in connection with a network device.

FIG. 11 shows a perspective view of a group of connector holders according to the embodiment shown in FIGS. 9-10 at the time that the connectors are inserted into a network device 100. The group of four connector holders allows the simultaneous and collective insertion and removal of thirty-two connectors.

Figure 12:
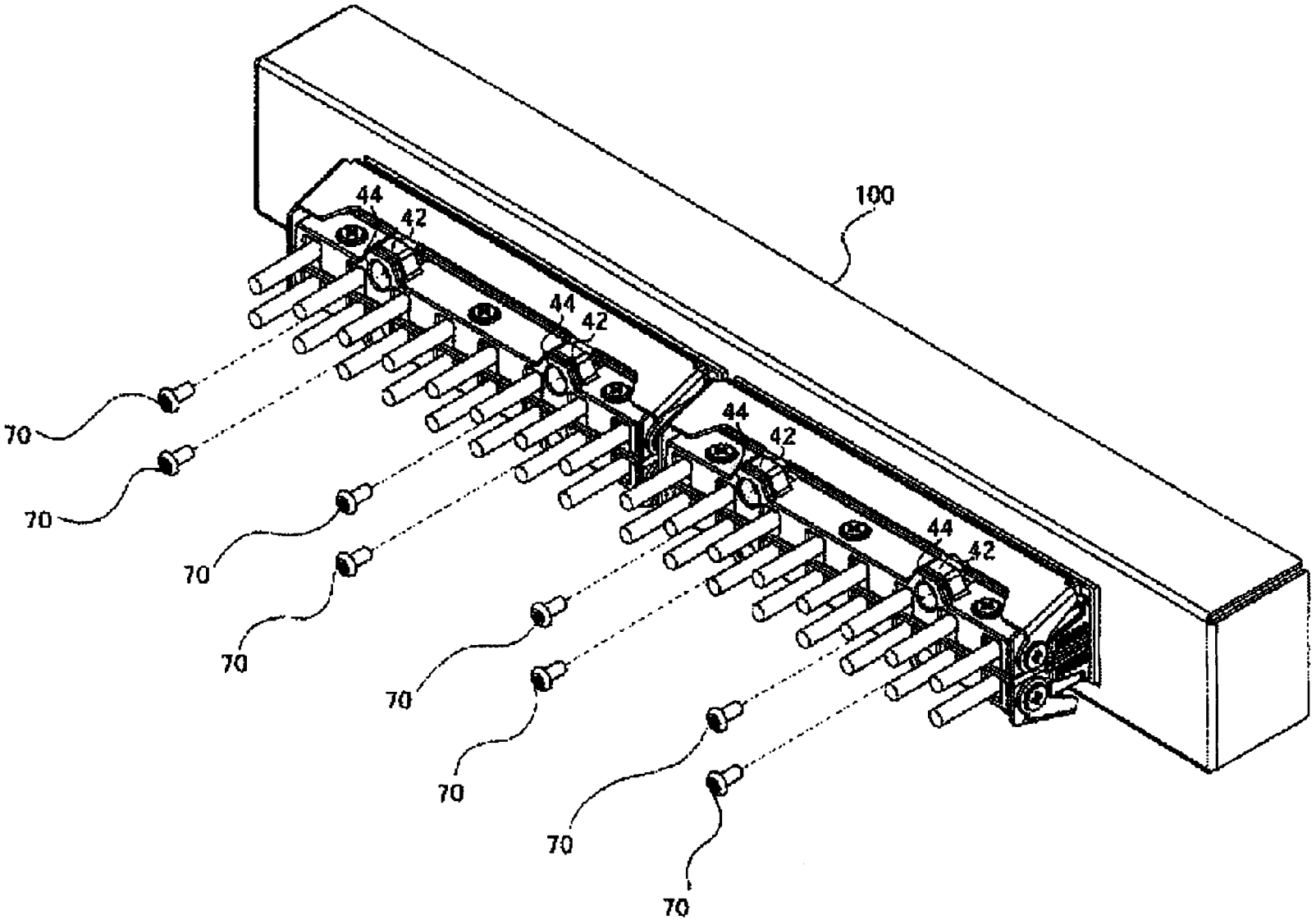
FIG. 12 is a perspective view of the cable connector depicted in FIG. 9 including a lock.

FIG. 12 is a perspective view of the group of connector holders depicted in FIG. 10 at the time when locks 70 are inserted. Once the lock is inserted, each lobe 54 prevents the respective press part 52 from being depressed, and the connectors 10 in the connector holder 1 cannot be removed from the network device 100. Thus, the lock 70 prevents a connector from being carelessly extracted from the network device.

FIG. 12 depicts two locks 70 being inserted in each connector holder. However, if even one lock is inserted into the connector holder, it will prevent the press part 52 from pressing down on the first lever 12 of the connector and releasing the lever 12 of the connector 10 from the stop 104 in the network device 100. The connectors cannot be removed until the lock 70 is removed from the connector holder. When the lock is removed from the connector holder, the lever 50 on the connector holder may once again rotate around the attaching piece 62 so that the press part 52 can press down on the first levers 12 of the connectors to release the lever shoulders 14 of each of the plurality of connectors 10 in the connector holder from the stops 104 in the network device, such that the connectors may be collectively removed.

Example embodiments of the present invention have now been described in accordance with the above advantages. It will be appreciated that these examples are merely illustrative of the invention. Many variations and modifications will be apparent to those skilled in the art.

What is claimed is:

1. A cable connector holder comprising:

a base configured to hold a plurality of cable connectors;

a press part configured to uniformly press down on a locking lever provided on each of the plurality of cable connectors such that the plurality of cable connectors can collectively be disengaged from a network device; and a security feature configured to secure the plurality of cable connectors to a network device.

2. A cable connector device comprising a plurality of cable connector holders as recited in claim 1, wherein the plurality of cable connector holders are attached to each other.

3. The cable connector holder according to claim 1, further comprising:

a holder attached to the base between the plurality of cable connectors and the press part.

4. The cable connector holder according to claim 3, further comprising:

an opening formed in the holder.

5. The cable connector holder according to claim 4, wherein the security feature comprises:

a piece extending perpendicular to the base, wherein the piece includes a threaded opening, wherein a central axis of the threaded opening corresponds to a central axis of the opening formed in the holder.

6. The cable connector holder according to claim 5, wherein the opening formed in the holder and the threaded opening formed in the piece extend perpendicular to the base and the holder further includes a removable lock piece insertable into the opening and the threaded opening.

7. The cable connector holder according to claim 6, further comprising a lobe on the press part, wherein the lobe is located corresponding to the location of the opening formed in the holder and the threaded opening formed in the piece extending perpendicular to the base.

8. The cable connector holder according to claim 7, wherein the lobe is configured to prevent the press part from being pressed downward by contacting the lock piece.

9. The cable connector holder according to claim 5, wherein the lock piece is a screw.

10. The cable connector holder according to claim 9, wherein the screw is a security screw.

11. A cable connector holder comprising:

a base configured to hold a plurality of cable connectors;

a lever rotatably attached to the base and extending above the plurality of cable connectors, wherein the lever is configured to uniformly press down on each of the plurality of cable connectors to render the plurality of cable connectors collectively removable from a network device; and a security feature configured to secure the plurality of cable connectors to a network device.

12. A cable connector device comprising a plurality of cable connector holders as recited in claim 11, wherein the plurality of cable connector holders are attached to each other.

13. The cable connector holder according to claim 11, further comprising:

a holder attached to the base between the plurality of cable connectors and the lever.

14. The cable connector holder according to claim 13, further comprising:

an opening formed in the holder.

15. The cable connector holder according to claim 14, further comprising:

a piece extending perpendicular to the base, wherein the piece includes a threaded opening, wherein a central axis of the threaded opening corresponds to a central axis of the opening formed in the holder.

16. The cable connector holder according to claim 15, wherein the opening formed in the holder and the threaded opening formed in the piece extend perpendicular to the base and the holder further includes a removable lock piece insertable into the opening and the threaded opening.

17. The cable connector holder according to claim 16, further comprising a lobe on the lever, wherein the lobe is located corresponding to the location of the opening formed in the holder and the threaded opening formed in the piece extending perpendicular to the base.

18. The cable connector holder according to claim 17, wherein the lobe is configured to prevent the lever from being pressed downward by contacting the lock piece.

19. The cable connector holder according to claim 15, wherein the lock piece is a screw.

20. The cable connector holder according to claim 19, wherein the screw is a security screw.

* * * * *